United States Patent [19]

Magnasco

[11] Patent Number: 4,979,302

[45] Date of Patent: Dec. 25, 1990

[54] ANGULARLY DISPOSED SCRAPER BLADE

[76] Inventor: Peter L. Magnasco, P.O. Box 173, Campbell, Calif. 95009

[21] Appl. No.: 374,993

[22] Filed: Jul. 3, 1989

[51] Int. Cl.[5] ..... B26B 3/00

[52] U.S. Cl. ..... 30/169; 30/172

[58] Field of Search ..... 30/169–172; 15/236.1

[56] References Cited

U.S. PATENT DOCUMENTS

| | | | |
|---|---|---|---|
| 785,556 | 3/1905 | Kent | 30/172 |
| 2,169,414 | 8/1939 | Giddings | 30/172 |
| 2,484,476 | 10/1949 | Teigland | 30/172 |
| 2,546,577 | 3/1951 | Young | 15/236 R |
| 2,846,764 | 8/1958 | Hyneman | 30/172 |
| 4,574,417 | 3/1986 | Magnasco | 30/172 X |

FOREIGN PATENT DOCUMENTS

| | | | |
|---|---|---|---|
| 355933 | 10/1950 | Switzerland | 30/172 |

*Primary Examiner*—Douglas D. Watts

[57] ABSTRACT

A scraping blade, for the removal of various surface coatings in combination with a scraping device, providing substantially flat rectangular angularly separate laterially connecting portions being primarily angularly divided and thereafter arranged so as to form a pair of individual angularly outspread apart principally similarly configured distinctly separate blade members, so as to be reversible in being attached or mounted to a scraping device by one blade member, with the other successive blade member, being angularly separated and disposed, entirely and completely independent of further support or support apparatus, having a cutting edge located on the outermost extreme, so as to engage and perform scraping on a work surface.

11 Claims, 1 Drawing Sheet

ANGULARLY DISPOSED SCRAPER BLADE

BACKGROUND—FIELD OF INVENTION

This invention relates to scraping blades for hand scrapers, and powered scraping devices, for use in surface preparation, to facilitate dependable blade performance, and reliability, on a wide variety of extensive surface preparation operations.

Many, if not most average consumers and professionals utilize hand scrapers and powered scraping equipment as a means of removing flaking paint materials, as well as a wide variety of other unwanted materials from surfaces in preparation for painting, or other forms of surface renewal, and cleaning. Such materials may be difficult to remove requiring scraping blades that can be implemented on scraping equipment that will work compentently on extreme surface conditions.

BACKGROUND—DESCRIPTION OF PRIOR ART

Heretofore, a variety of scraping blades have been implemented on scraping devices for use in surface preparation operations.

One such Blade is narrow and recessed into the scraping device body. By design, the cutting edge is not inclined to resolutely engage surface materials, rendering it moderately inadequate to perform on extensive scraping operations.

Another type of blade is very flexible, which would seem to prohibit the wide use of this type of blade on extensive scraping operations. During extensive scraping operations, blades must be capable of withstanding and performing on harsh surface conditions normally encountered.

Yet another type of blade is secured to supports configured to maintain and hold the blades during scraping operations. The support mechanisms on this type of scraping device are essential, and after many extensive scraping operations, may require replacement, along with the blades, due to fatigue.

Most users, therefore, would find it desirable to use a durable blade, designed to be independently secured to a scraping device, that would not require additional support to reliably perform extensive scraping operations, that would be easily renewable when the cutting edges are exhausted.

OBJECTS AND ADVANTAGES

Accordingly, I claim the objects and advantanges of the invention:

To provide a scraping blade, to be used in combination with a scraping device, configured to be firmly secured to a scraping device, by either one of two separate angularly disposed blade members, with the other or successive blade member being angularly disposed at a desired working angle in relation to the work surface to perform various different types of scraping operations, independent of further support from the tool body or any other type of support mechanisms, eliminating the need to eventually replace such mechanisms over a period of time.

In addition, I claim the following additional objects and advantages:

To provide such a blade which may be alternately reversed and attached or mounted to a scraping device, so as to provide a fresh cutting edge upon the work surface, when one cutting edge has been exhausted.

To provide such a blade which is durably constructed, that is easily renewable on the scraping device, for sharpening or replacement, when both cutting edges have been exhausted.

These together with other objects and advantages, will become subsequently apparent, and are more fully hereinafter described and claimed and reside in the following description and accompanying drawing.

DRAWING FIGURES

DRAWING REFERENCE NUMERALS

Figure 3:
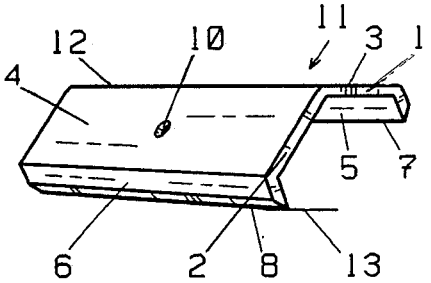
FIG. 3 is a perspective view showing the outer side of one blade member, of the scraping blade, and a segment of the inner side of the other, or successive blade member, of the scraping blade.

1. Blade Member, of the scraping blade 11
2. Blade Member, of the scraping blade 11
3. Blade Portion, of blade member 1
4. Blade Portion, of blade member 2
5. Blade Portion, of blade member 1
6. Blade Portion, of blade member 2
7. Beveled Cutting Edge, of blade portion 5
8. Beveled Cutting Edge, of blade portion 6
9. Bore, of blade portion 3
10. Bore, of blade portion 4
11. Generally Designates the Scraping Blade, FIG. 1, FIG. 3, FIG. 4
12. Division Point, of scraping blade members 1,2, FIG. 1 and throughout
13. Work Surface, FIG. 3, FIG. 4
14. Generally Designates A Scraping Device, FIG. 4

DETAILED DESCRIPTION OF THE INVENTION

Figure 1:
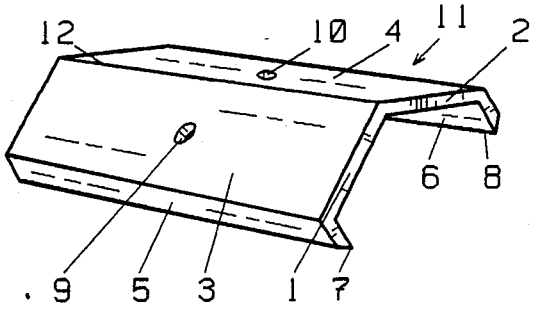
FIG. 1 is a perspective elevational view of the scraping blade constructed in accordance with the present invention.
Figure 2:
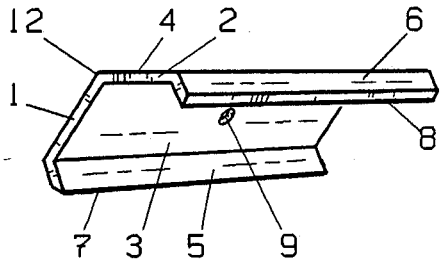
FIG. 2 is a perspective view showing a segment of the inner side of one blade member, of the scraping blade, and a segment of the outer side of the other, or successive blade member, of the scraping blade.
Figure 4:
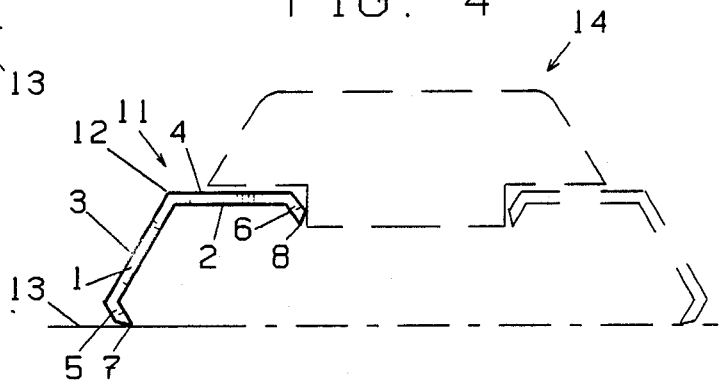
FIG. 4 is a side view of the scraping blade, and showing possible mounting to a scraping device.
Figure 5:
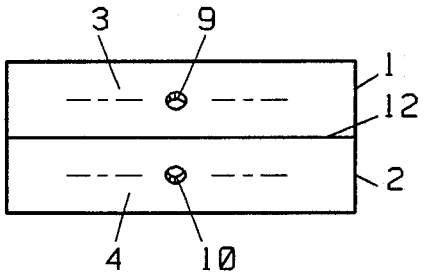
FIG. 5 is a top view of the scraping blade, showing the outer side of the two blade members, of the scraping blade.
Figure 6:
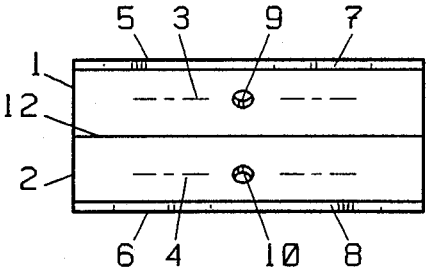
FIG. 6 is a bottom view of the scraping blade, showing the inner side of the two blade members, of the scraping blade.

With attention being invited to FIG. 1 of the accompanying drawing, the scraping blade 11, is comprised of substantially flat rectangular angularly separate laterally connecting blade portions 3,4,5,6, being primarily angularly divided 12, and thereafter arranged so as to form a pair of individual angularly outspread apart principally similarly configured distinctly separate blade members 1,2, being initially adjoining and, therefrom, 12, being immediately subsequently thereafter primarily outwardly disposed and angularly divided apart, individually comprising, an initial primary outwardly disposed blade portion 3,4, with a bore opening 9,10, near midway, thereon, of which a securing device might pass through, and a then inwardly disposed end blade portion 5,6, having a bevelled cutting edge 7,8, thereon, inwardly inclined and located on the outermost extreme, thereof, as is principally shown in FIG. 4 of the accompanying drawing.

DETAILED OPERATION OF THE INVENTION

In operation, the scraping blade is used in combination with a scraping device to perform a variety of scraping operations. With attention being invited to FIG. 4 of the accompanying drawing, the scraping blade 11, is attached or mounted to the scraping device 14, by blade member 2, primary outwardly disposed blade portion 4, with the other or successive blade member 1, being, thereafter, angularly disposed and independent of further support from the tool body, or any other type of support mechanism, at a desired working angle in relation to the work surface 13, for the scraping operation to be performed. This enables bevelled cutting edge 7, of blade member 1, located on the outermost extreme of blade portion 5, to be engaged on the work surface 13, whereupon, the scraping blade 11, is moved in a back and forth motion upon the work surface 13, allowing bevelled cutting edge 7, to accomplish the removal of unwanted materials from the work surface 13, and perform the scraping operation, as principally shown in FIG. 4 of the accompanying drawing.

Inasmuch as both scraping blade members 1,2, are similar, the scraping blade 11, may be alternately reversed in mounting to a scraping device, so as to provide a fresh cutting edge upon the work surface 13, when one cutting edge 7,8, has been exhausted. With attention now being invited to FIG. 3 of the accompanying drawing, the scraping blade 11 could be attached or mounted to a scraping device so as to have blade member 2, bevelled cutting edge 8, located on the outermost extreme of blade portion 6, engage the work surface 13, wherein, the scraping blade 11, would be attached or mounted to a scraping device by blade member 1, primary outwardly disposed blade portion 3, allowing bevelled cutting edge 8, to accomplish the removal of unwanted materials from the work surface 13, and perform the scraping operation in essentially the same manner as has been previously herein described and principally shown in the accompanying drawing.

Readers may ascertain that the scraping blade is intended to be of simple construction and yet eliminate many of the problems normally encountered in using scraping equipment, even when used on extreme scraping conditions. Being of single piece construction, the scraping blade will provide reliable service while being relatively inexpensive, and will be easily renewable on the tool when necessary.

The foregoing is considered as illustrative only of the principals of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

I claim:

1. A scraping blade, for use on a dual blade scraping device, for the removal of various surface coatings, said scraping blade comprised of substantially flat rectangular separate laterally connecting portions being angularly disposed and arranged so as to form a pair of individual angularly outspread apart principally similarly configured distinctly separate blade members, being initially adjoining and, therefrom, being immediately subsequently thereafter outwardly disposed and angularly divided apart, said blade members individually comprising, an initially outwardly disposed portion, which may have a opening near midway, thereon, of which a securing device might pass through, and a then inwardly disposed portion, having a bevelled cutting edge, thereon, inwardly inclined and located on the outermost extreme.

2. The scraping blade of claim 1, wherein, said scraping blade being principally so configured to be attached or mounted to said dual blade scraping device to perform scraping on a work surface.

3. The scraping blade of claim 1, wherein, said scraping blade having a pair of individual angularly outspread apart distinctly separate blade members, to be attached or mounted to said dual blade scraping device by one blade member, thereof, with the other successive blade member, thereof, being angularly disposed and separated, therefrom, entirely and completely independent of further support or support apparatus.

4. The scraping blade of claim 1, wherein, said scraping blade having a pair of individual angularly outspread apart distinctly separate blade members, to be attached or mounted to said dual blade scraping device by one blade member, thereof, with the other successive blade member, thereof, being angularly disposed and separated, therefrom, having a cutting edge, thereon, located on the outermost extreme, thereof, so as to engage a work surface.

5. The scraping blade of claim 1, wherein, said scraping blade comprising a pair of principally similarly configured blade members so as to be optionally attached or mounted to said dual blade scraping device by either blade member.

6. The scraping blade of claim 5, wherein, said scraping blade, being principally so configured, is alternately reversible in mounting.

7. A scraping blade, for the removal of various surface coatings, said scraping blade comprised of substantially flat rectangular separate laterally connecting portions being angularly disposed and arranged so as to form a pair of individual angularly outspread apart principally similarly configured distinctly separate blade members, being initially adjoining and, therefrom, being immediately subsequently thereafter outwardly disposed and angularly divided apart, individually comprising, an initially outwardly disposed portion, which may have a opening near midway, thereon, of which a securing device might pass through, and each said blade members having a then inwardly disposed portion, having a bevelled cutting edge, thereon, inwardly inclined and located on the outermost extreme.

8. The scraping blade of claim 7, wherein, said scraping blade being principally so configured may be attached or mounted to a dual blade scraping device to perform scraping on a work surface.

9. The scraping blade of claim 8, wherein, said scraping blade, may be attached or mounted to said dual blade scraping device by one blade member, thereof, with the other successive blade member, thereof, being angularly separated and disposed, therefrom, having a cutting edge, thereon, located on the outermost extreme, thereof, so as to engage a work surface.

10. The scraping blade of claim 8, wherein, said scraping blade comprising a pair of principally similarly configured blade members may be optionally attached or mounted to said dual blade scraping device by either blade member.

11. The scraping blade of claim 10, wherein, said scraping blade, being principally so configured, is alternately reversible in mounting.

* * * * *